United States Patent [19]

Ota et al.

[11] Patent Number: 4,668,036

[45] Date of Patent: May 26, 1987

[54] LARGE PICTURE DISPLAY DEVICE

[75] Inventors: Makoto Ota, Yokohama; Akira Naito, Machida; Toyohiro Fujiwara, Sagamihara, all of Japan

[73] Assignee: Mitsubishi Denki Kabushiki Kaisha, Tokyo, Japan

[21] Appl. No.: 799,752

[22] Filed: Nov. 19, 1985

[30] Foreign Application Priority Data

Nov. 20, 1984 [JP] Japan ..... 59-243216

[51] Int. Cl.[4] ..... H01R 13/627

[52] U.S. Cl. ..... 339/45 R; 339/75 R; 339/91 R

[58] Field of Search ..... 339/45 R, 45 M, 75 R, 339/75 M, 91 R, 93 R, 93 C

[56] References Cited

U.S. PATENT DOCUMENTS

| | | | |
|---|---|---|---|
| 1,587,120 | 6/1926 | Haddock | 339/93 R |
| 2,938,200 | 5/1960 | Dupree | 340/381 |
| 3,329,925 | 7/1967 | Johnson et al. | 339/91 R |
| 3,363,218 | 1/1968 | Breivogel | 339/93 C |
| 3,675,242 | 7/1972 | Hammell | 340/381 |
| 3,816,827 | 6/1974 | Lynn, Jr. | 340/381 |

*Primary Examiner*—John McQuade

*Attorney, Agent, or Firm*—Armstrong, Nikaido, Marmelstein & Kubovcik

[57] ABSTRACT

Disclosed herein is a large picture display device including a plurality of display units mounted to a support frame. The large picture display device comprises a push latch stopper mounted to the display unit, a push latch mounted to the support frame and adapted to mate with the push latch stopper, and a spring means provided on the support frame. With this arrangement, when the display unit is inserted into the support frame, the push latch stopper is engaged with the push latch to be locked, thereby permitting the display unit to be retained by the support frame. When the push latch is unlocked, the display unit is drawn because the spring means forwardly biases the display unit.

5 Claims, 6 Drawing Figures

LARGE PICTURE DISPLAY DEVICE

BACKGROUND OF THE INVENTION

This invention relates to a large picture display device having a plurality of display units arranged on a support frame, and more particularly to an improvement in mount mechanism of the display units.

Referring to FIGS. 5 and 6 which show a conventional large picture display device, the device includes a display unit 1 having a display plane 1*a*, guide rails 2 for guiding and supporting the display unit 1 upon insertion of the unit into a support frame, guide rail support plates 3 for supporting the guide rails 2, an electric signal connector 4 provided on the display unit side, a connector 5 engaged with the connector 4, and a back plate 6 for supporting the connector 5. The support frame for mounting the display unit 1 thereon is formed by the guide rails 2, the guide rail support plates 3 and the back plate 6.

Mounting operation of the display unit is in the following manner. As shown in FIG. 5, the display unit 1 is inserted into the support frame along the guide rails 2. Then, as shown in FIG. 6, the display unit 1 is pushed until the connector 4 is fully engaged with the connector 5, so as to effect electrical and mechanical connection. Thus, a plurality of display units are fully mounted and arranged to form a large picture plane.

When the display unit 1 is intended to be removed, it is slightly forwardly pushed through holes 6*a* formed through the back plate 6, and is drawn from the display plane 1*a*.

In the conventional large picture display device as described above, a removing work of the display units must be carried out on both the back plate 6 side and the display plane 1*a* side, which causes inconvenience in maintenanceability. Further, as the display unit 1 is retained only by engagement of the connectors, it is forwardly slided down upon downward inclination of the display plane 1*a*, which causes limitation of installation condition of the device. Further, the device is less durable against vibration, and resultantly there frequently occurs bad contact of the connectors 4 and 5.

SUMMARY OF THE INVENTION

Accordingly, it is an object of the present invention to provide a large picture display device which may attain easy maintenance of the display units.

It is another object of the present invention to provide a large picture display device which may secure supporting of the display units and attain reduced limitation of installation condition.

It is a further object of the present invention to provide a large picture display device which may reduce trouble due to bad contact of the connectors.

According to the present invention, the large picture display device including a plurality of display units mounted to the support frame comprises a push latch stopper mounted to the display unit, a push latch mounted to the support frame and adapted to mate with the push latch stopper, and a spring means provided on the support frame.

With this arrangement, when the display unit is inserted into the support frame, the push latch stopper is engaged with the push latch to be locked, thereby permitting the display unit to be retained by the support frame. When the push latch is unlocked, the display unit is drawn because the spring means forwardly biases the display unit.

Other objects and features of the invention will be more fully understood from the following detailed description and appended claims when taken with the accompanying drawings.

DETAILED DESCRIPTION OF THE PREFERRED EMBODIMENTS

Figure 1:
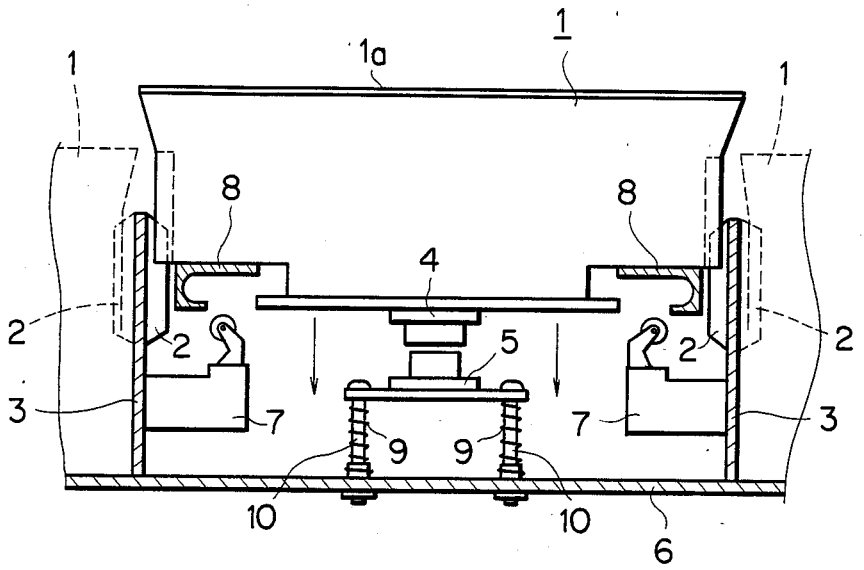
FIG. 1 is a plan view of the large picture display device of a preferred embodiment according to the invention, showing a condition before the display unit is inserted.

Referring to FIGS. 1 to 4 which show a large picture display device of a preferred embodiment according to the present invention, push latches 7 are fixed to guide rail support plates 3 of a support frame, and push latch stoppers 8 for fixing the display unit 1 under a latched condition of the push latches 7 are mounted to a back surface of the display unit on both ends thereof. A push latch is a commercial item of manufacture and includes a base 7 mounted on one piece to be detachably connected to another and carries a snap spring arm on which a roller is mounted. It also has a push latch stopper plate 8 mounted on the second piece to be detacheably connected and when pushed together by a relatively weak force, the snap spring is actuated and the rotary arm moves to lodge the roller in the complimentary notch of the stopper plate. Reference numerals 9 and 10 designate spring means having a biasing force larger than an insertion pressure of the connectors 4 and 5 upon insertion of the display unit and support columns for supporting the connectors 5 and permitting easy movement thereof, respectively. The springs 9 and the support columns 10 form a spring means for forwardly biasing the display unit 1. The other constitution is substantially similar to that in the prior art device. Therefore, identical or corresponding parts are designated by the same reference numbers, and explanation thereof will be omitted.

Figure 2:
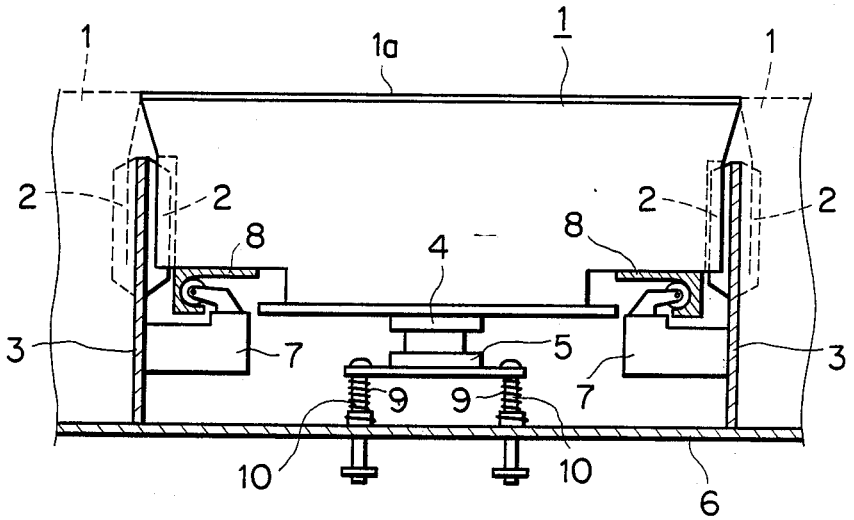
FIG. 2 is a plan view similar to FIG. 1, showing a condition after the display unit is fully inserted.

In the following, there will be described operation of the display unit in the invention. When the display unit 1 is moved along the guide rails 2 in a direction as depicted by arrows as shown in FIG. 1, and is inserted to such a position as shown in FIG. 2, the push latches 7 are brought into a lock condition to fix the push latch stoppers 8. At the same time, the springs 9 urge the connector 5 by a spring force larger than the insertion pressure of the connectors 4 and 5 to fully connect both the connectors 4 and 5. Under the condition, electrical connection and mechanical retention of the display unit are completed to carry out displaying.

Figure 3:
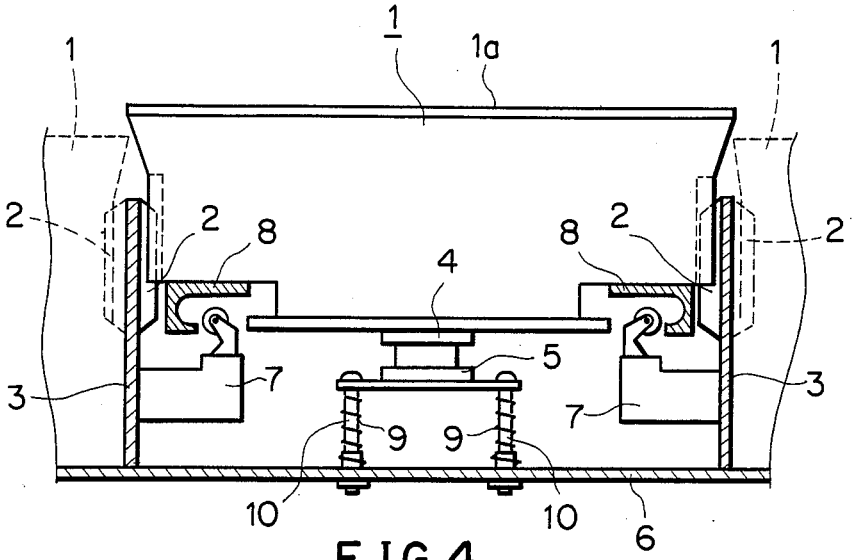
FIG. 3 is a plan view similar to FIG. 1, showing a condition where the push latches are unlocked.
Figure 4:
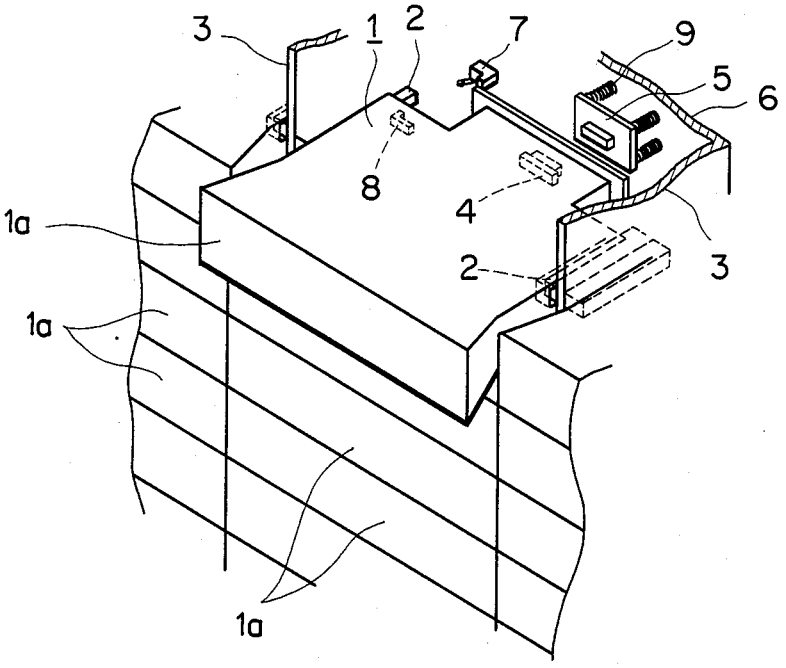
FIG. 4 is a partially perspective view of the large picture display device formed by a plurality of display units.
Figure 5:
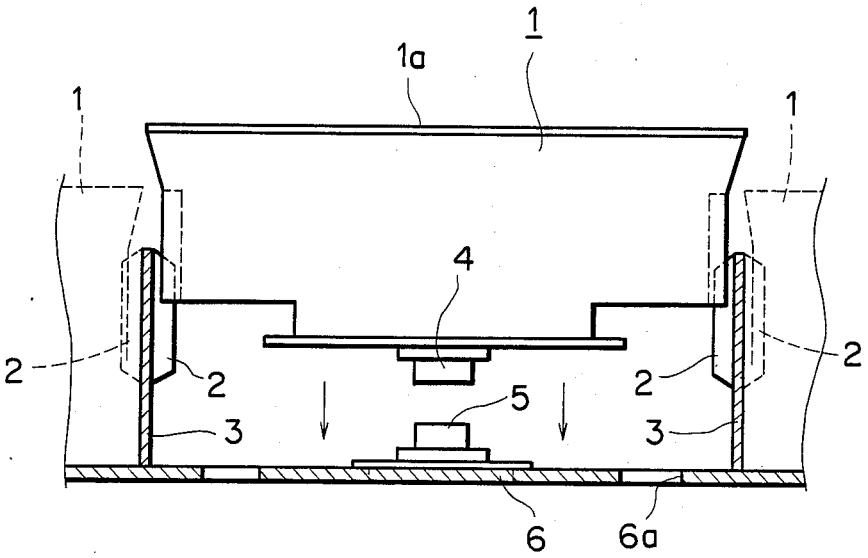
FIG.5 (PRIOR ART)
FIG. 5 is a plan view of the conventional large picture display device, showing a condition before the display unit is inserted.
Figure 6:
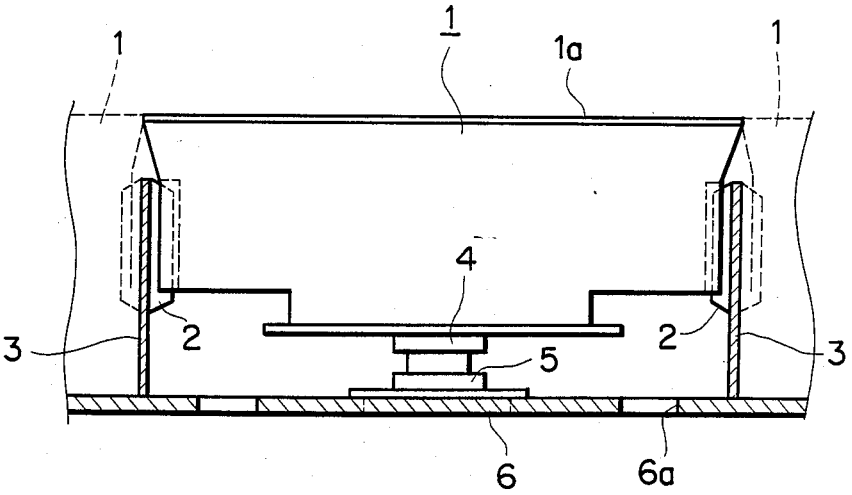
FIG.6 (PRIOR ART)
FIG. 6 is a plan view similar to FIG. 5, showing a condition after the display unit is inserted.

When the display unit 1 is intended to be removed, the display plane 1*a* is pushed to release the lock condition of the push latches 7. As a result, the display unit 1 is urged in a direction of the display plane 1*a* by a force of the push latches 7 and the springs 9 as shown in FIG. 3. Thereafter, a projecting part of the display unit 1 is drawn by hands for example. FIG. 4 shows a partially perspective view of the large picture display device according to the present invention where a plurality of display units 1 are arranged to form a picture plane.

Although the push latch stoppers 8 are provided on the back surface of the display unit in the preferred embodiment, it may be provided on side surfaces of the display unit wherein the same effect is exhibited. Further, although the connectors 4 and 5 are singly provided respectively, a plurality of the connectors may be employed. The springs 9 may be of any structure having a spring function in substitution for a coil spring as shown.

Furthermore, although the above-mentioned embodiment is applied to a display device, the invention may be also applied to other electronic equipments, and in the case that maintenance of equipments incorporated in an operating panel or the like is required to be carried out on a single side, the same effect as with the above-mentioned embodiment may be exhibited.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A picture display device including a support frame having a forward opening and a receiving portion and a display unit to be inserted into said support frame through said forward opening so as to be disposed in said receiving portion of the support frame comprising:

(a) a stopper mounted on a back surface of said display unit;

(b) a push latch mounted on a backward portion of said receiving portion in said support frame so as to be correspondingly placed to said stopper, said push latch being mated with said stopper by inserting said display unit into said support frame to a predetermined extent to lock said stopper and said push latch and being released from said stopper when said display unit is inserted into said support frame to more than said predetermined extent;

(c) connecting means composed of a pair of connectors provided between said back surface of the display unit and a backward end portion of said receiving portion in the support frame, said connecting means being connected to supply an electrical signal to said display unit and arranged along such a direction to insert and release said display unit into and out of said support frame, said connecting means being connected upon insertion of said display unit into said receiving portion of the support frame and being released upon release of said display unit from said receiving portion in said support frame; and (d) spring means provided between one of the connectors at the backward end portion of the receiving portion and biasing said one of the connectors toward said forward opening direction, said spring means allowing said pair of connectors to be connected by pressing said one of the connectors against the other one of the connectors when said stopper is locked by said push latch, said spring means allowing a part of the display unit to project from said receiving portion by pushing out either one of the connectors when said stopper is released from said push latch.

2. A display device as defined in claim 1, wherein a pair of stoppers are provided on said back surface of said display unit at both lateral ends thereof and a pair of push latches are provided on said receiving portion.

3. A display device as defined in claim 1, wherein said pair of connectors are mounted at a central portion of said back surface of the display unit and the connectors are adapted to be biased by said spring means.

4. A display device as defined in claim 1, wherein said pair of connectors are provided between a central portion of said back surface of the display unit and a central portion of said spring means for engaging with each other.

5. A display device as defined in claim 1, wherein said spring means have support columns extending from the backward end portion of the receiving portion in the support frame, a member movable along and supported by said support columns and having one of the connectors thereon, and a spring provided between said member and the backward end portion of the receiving portion biasing said member toward the forward opening direction.

* * * * *